US009234376B2

(12) United States Patent
Trulaske, Sr.

(10) Patent No.: US 9,234,376 B2
(45) Date of Patent: Jan. 12, 2016

(54) TOP HUNG DOOR ASSEMBLY

(75) Inventor: Steven L. Trulaske, Sr., St. Louis, MO (US)

(73) Assignee: True Manufacturing Co, Inc., O'Fallon, MO (US)

( * ) Notice: Subject to any disclaimer, the term of this patent is extended or adjusted under 35 U.S.C. 154(b) by 190 days.

(21) Appl. No.: 12/732,784

(22) Filed: Mar. 26, 2010

(65) Prior Publication Data

US 2010/0242370 A1 Sep. 30, 2010

Related U.S. Application Data

(60) Provisional application No. 61/165,111, filed on Mar. 31, 2009.

(51) Int. Cl.

| | |
|---|---|
| ***E05D 15/06*** | (2006.01) |
| ***E05D 13/00*** | (2006.01) |
| ***A47F 3/04*** | (2006.01) |
| *F25D 23/02* | (2006.01) |
| *E05D 15/08* | (2006.01) |

(52) U.S. Cl.

CPC ..... *E05D 15/0652* (2013.01); *A47F 3/043* (2013.01); *A47F 3/0434* (2013.01); *E05D 13/14* (2013.01); *E05D 15/0626* (2013.01); *E05D 15/0634* (2013.01); *E05D 15/08* (2013.01); *E05Y 2201/706* (2013.01); *E05Y 2600/00* (2013.01); *E05Y 2600/622* (2013.01); *E05Y 2800/12* (2013.01); *E05Y 2900/00* (2013.01); *E05Y 2900/204* (2013.01); *F25D 23/021* (2013.01)

(58) Field of Classification Search

CPC . E05D 15/0652; E05D 15/0626; E05D 13/14; A47F 3/0434

USPC ..... 49/404, 425, 409, 410, 445–447, 426, 49/427; 16/81, 194, 198

See application file for complete search history.

(56) References Cited

U.S. PATENT DOCUMENTS

| | | | | |
|---|---|---|---|---|
| 1,996,580 | A * | 4/1935 | Leicht et al. | 16/205 |
| 2,858,408 | A * | 10/1958 | Barroero | 49/70 |
| 3,628,289 | A | 12/1971 | Buffington et al. | |
| 3,636,661 | A * | 1/1972 | Strawsine | 49/413 |
| 3,660,939 | A | 5/1972 | Suita | |
| 3,696,560 | A * | 10/1972 | Hallin | E05D 15/0634 16/105 |

(Continued)

FOREIGN PATENT DOCUMENTS

| | | |
|---|---|---|
| CL | 41634 | 9/1993 |
| CL | 45693 | 5/2007 |

(Continued)

*Primary Examiner* — Katherine Mitchell
*Assistant Examiner* — Marcus Menezes
(74) *Attorney, Agent, or Firm* — Polster, Lieder, Woodruff & Lucchesi, LC

(57) ABSTRACT

This top hung door assembly (10) for a merchandiser includes a pair of doors 12, 14 each having an upper frame member (20) including a metal reinforcing member (22). An upper track member (16) is provided including depending flange members (36) and (38) each having a roller mounting portion (48). A pair of spaced wheel assemblies (60) is provided including a bracket (50) having a lower portion (54) connected to the upper door frame and an upper portion (52) carrying a pair of rollers (60) received by the roller mounting portion (46). The upper track member (16) includes associate track members (46) having spaced notches (49) to facilitate mounting the doors. Also the flange members have flexible tips (44) facilitating the sealing and mounting of the doors.

9 Claims, 6 Drawing Sheets

(56) References Cited

U.S. PATENT DOCUMENTS

| | | | | |
|---|---|---|---|---|
| 3,796,405 | A * | 3/1974 | Rystad | E05D 15/0634 248/316.7 |
| 3,805,450 | A | 4/1974 | Forcina | |
| 3,848,426 | A | 11/1974 | Whitney | |
| 3,896,508 | A * | 7/1975 | Doan | 4/557 |
| 3,983,600 | A | 10/1976 | Smith | |
| 4,102,545 | A * | 7/1978 | Jay | 292/57 |
| 4,115,953 | A | 9/1978 | Brosenius | |
| 4,126,912 | A | 11/1978 | Johnson | |
| 4,148,535 | A | 4/1979 | Fenwick | |
| 4,467,562 | A | 8/1984 | Hemmerling | |
| 4,754,573 | A * | 7/1988 | van Rooij et al. | 49/370 |
| 5,181,296 | A | 1/1993 | Williams | |
| 5,272,839 | A * | 12/1993 | Karhu | 49/409 |
| 5,285,596 | A | 2/1994 | Kinsey | |
| 6,142,260 | A | 11/2000 | Shin | |
| 6,336,247 | B1 * | 1/2002 | Schnoor | E05D 15/0634 16/105 |
| 6,352,097 | B1 | 3/2002 | Kern et al. | |
| 6,381,904 | B1 * | 5/2002 | Tedescucci | 49/409 |
| 6,766,847 | B1 | 7/2004 | Wang | |
| 7,546,904 | B2 | 6/2009 | Wernas | |
| 2007/0062121 | A1 | 3/2007 | Tarrega Illoret | |
| 2007/0101540 | A1 * | 5/2007 | Martin | 16/97 |
| 2007/0180774 | A1 * | 8/2007 | Romero et al. | 49/425 |
| 2008/0066875 | A1 | 3/2008 | Okachi | |
| 2008/0092330 | A1 | 4/2008 | Haab et al. | |
| 2009/0145039 | A1 * | 6/2009 | Shehoski | E05D 15/063 49/409 |

FOREIGN PATENT DOCUMENTS

| | | | |
|---|---|---|---|
| CL | 2007003016 | A1 | 7/2008 |
| CN | 2457290 | Y | 10/2001 |
| CN | 2457290 | Y | 3/2006 |
| CN | 2766010 | Y | 3/2006 |
| CN | 101035960 | A | 9/2007 |
| DE | 202008015526 | U1 | 2/2009 |
| EP | 1679281 | A1 | 7/2006 |
| JP | 07-062945 | | 3/1995 |
| JP | 09-021262 | | 1/1997 |
| JP | 2001-193342 | | 7/2001 |
| JP | 2005-048539 | | 2/2005 |

* cited by examiner

TOP HUNG DOOR ASSEMBLY

CROSS-REFERENCE TO RELATED APPLICATIONS

This application claims the benefit of provisional patent application Ser. No. 61/165,111 filed Mar. 31, 2009, which is incorporated herein by reference.

STATEMENT REGARDING FEDERALLY SPONSORED RESEARCH

Not Applicable.

BACKGROUND OF THE INVENTION

This invention relates generally to a top hung door assembly for a cabinet and particularly to an assembly which can be used for glass fronted display cabinets for beverages, food products and the like.

In the prior art and, for example, in a patent owned by the assignee of the present application, namely, U.S. Pat. No. 3,328,106 Self-Closing Cabinet Doors is known. This particular patent, utilizes an offset counterweight system having a double bent guide tube which directs the sash-line through two 90° turns and is essentially a bottom supported, guided door.

As pointed out in U.S. Pat. No. 3,328,106 the use of pulleys had not proved successful because the sash-line tends to slip off the pulleys, which was a problem solved by the use of a double bent guide tube. On the other hand, the guide tube does not have the relatively frictionless free motion of a pulley system such as a ball bearing pulley system.

The prior art discloses several examples of top hung doors. However, there are none known which have the combination of features that the present top hung system reveals. For example, U.S. Patent Publication No. 2007/0101540A1 discloses a top hung elevationally adjustable wheel system suitable for a shower door. However, this system does not reveal a door suitable for a merchandiser and having the combination of features that this system has such as a metal stiffening member, or an auxiliary track member or wheel mounting brackets.

The present invention overcomes the disadvantages of the known prior art systems.

SUMMARY OF THE INVENTION

The present Top Hung Mounted Rolling Sliding Door System overcomes the disadvantages of the prior art sliding door systems by providing a top hung door which has an upper mounting used in conjunction with a lower guidance system. The upper mounting system includes an upper track member having depending flanges with wheel mounting portions receiving a pair of spaced rollers each having a bracket with a lower portion connected to the door frame and an upper portion carrying a wheel received by the roller mounting portion.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

Figure 1:
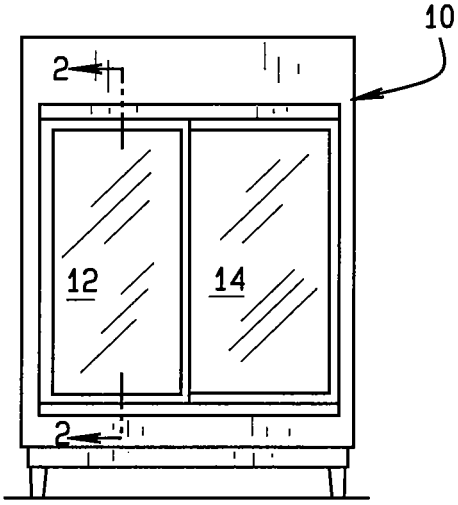
FIG. 1 is an elevational view of a merchandiser.
Figure 2:
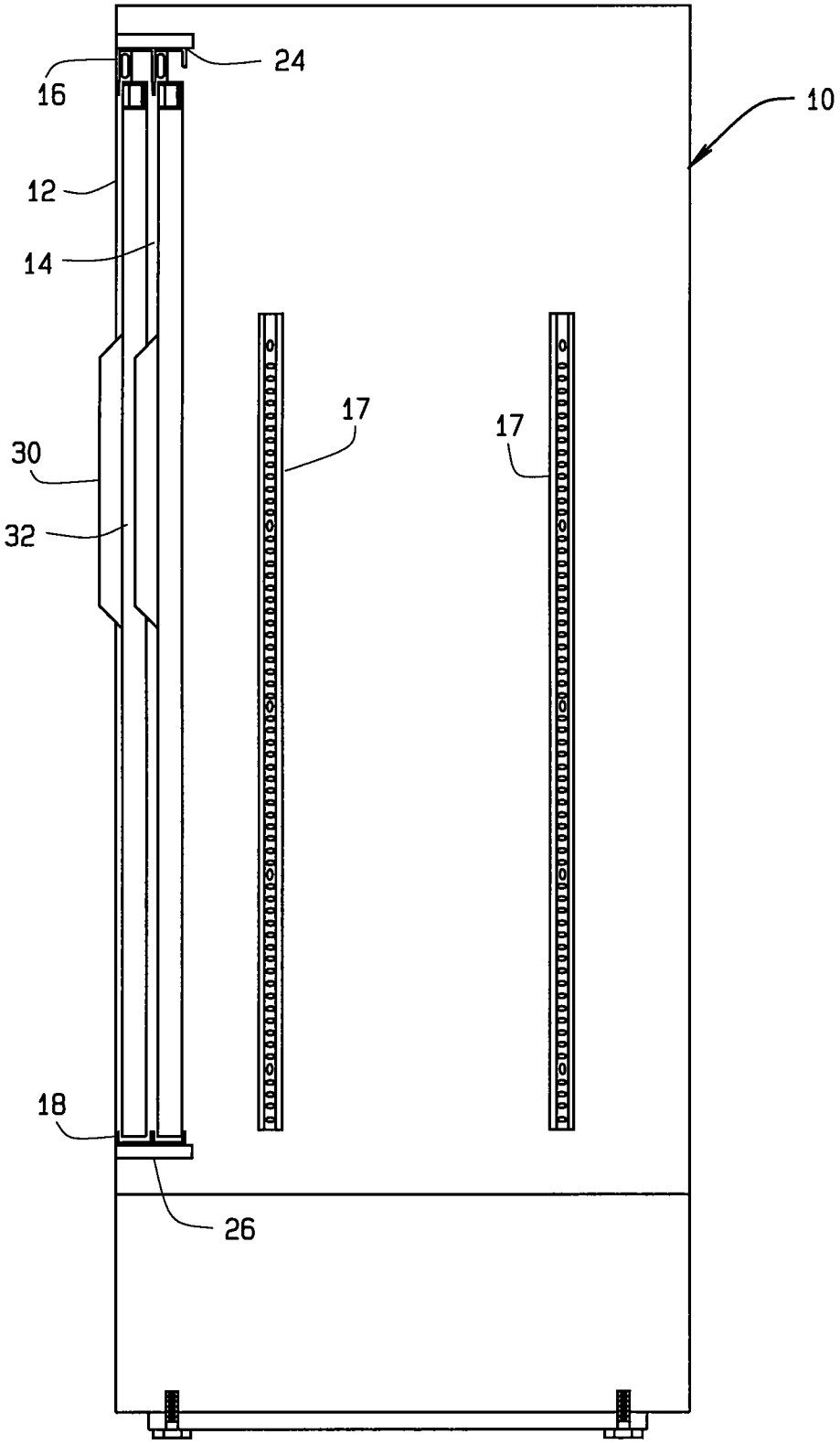
FIG. 2 is a cross-sectional view taken on line 2-2 of FIG. 1.

Referring now to the drawings and first to FIGS. 1 and 2 it will be understood that the merchandiser 10 is a refrigerator of the type found throughout mall stores but particularly at checkout locations adjacent the checkout counters for dispensing candy bars, beverages and similar snack items.

In general, the merchandiser in question includes a display area provided with shelves (not shown) which are carried by interior shelf supports 17. It will be understood that the merchandisers 10 have a pair of adjacent outer and inner sliding doors 12 and 14 equipped with door pulls 30 and 32 shown in FIG. 2 by which the doors are opened. Track members 16 and guide members 18 are provided, said track members 16 and guide members 18 being aligned vertically. Distinguishing from prior art systems of the type shown in FIG. 1A, which provide a bottom guide and roller door support system, the present door relies on a top hung system.

Figure 1A:
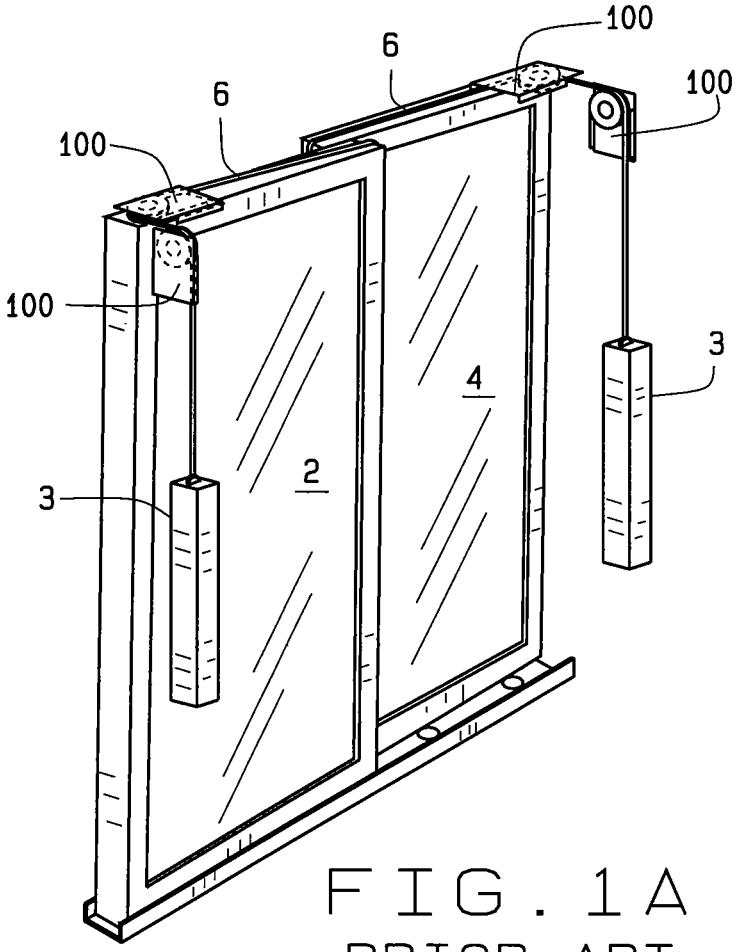
FIG. 1A PRIOR ART
FIG. 1A is a perspective view of a prior art system.

As shown in FIG. 1A, a prior art installation includes a pair of doors 2, 4 installed side-by-side. Each door has an associated cord 6 which extends across the top of each respective door 2, 4, and about respective horizontal and vertical pulley assemblies 100. The end of each cord is connected to a weight 3. The pulley assemblies 100 and weights 3 are used in the current installation described herein as shown in FIGS. 4-6, and 14.

In this system the track members 16 and guide aligned members 18 extend essentially the full length of the merchandiser 10 and are supported respectively by longitudinal members 24 and 26 of wood attached to the merchandiser body.

Figure 7A:
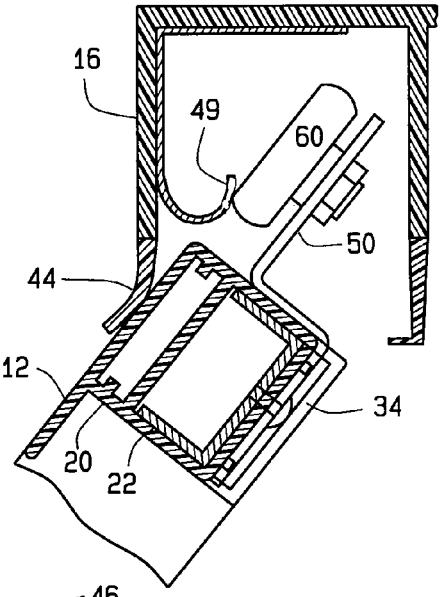
FIG. 7A is an enlarged fragmentary cross-sectional view taken on line 7A-7A of FIG. 7 illustrating the roller positioning during the door mounting.
Figure 7:
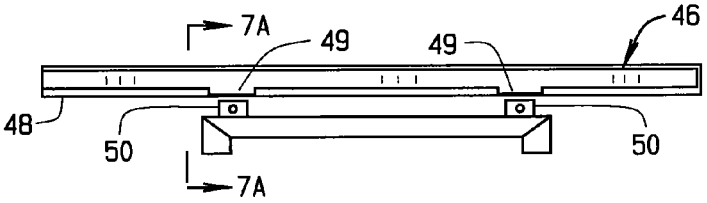
FIG. 7 is a view of the auxiliary track illustrating the positioning of the roller brackets relative to the notches during door installation.
Figure 8:
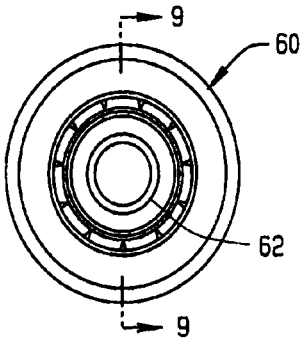
FIG. 8 is an elevational view of a roller.
Figure 9:
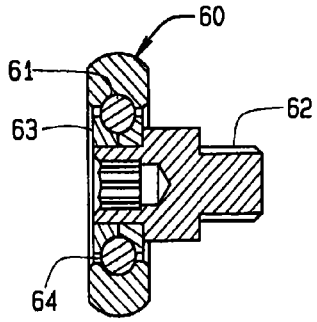
FIG. 9 is a cross-sectional view taken on line 9-9 of FIG. 8.

The top hung support system will now be particularly described by reference to FIG. 3, FIG. 7 and FIG. 7A. The track 16 is formed by two depending flange members 36, 38 and a stub member 40 connected by a web 42, all of plastic material. It will be observed that each of the depending flange members 36 and 38 includes a protective flexible tip 44 of bendable plastic material, such as polyone C75A0 Black Flex vinyl, molded onto the respective flange members 36 and 38 adjacent the associated doors 12 and 14. As shown in FIG. 7, the door is lifted into an incipient mounted position. As shown in FIG. 7A the rollers are swung into position by bending the relatively flexible material of the tip 44 until the rollers, once received by the notches 49 and then lowered into place in the J-shaped portion 48 of the tracks 46, support the doors 12 and 14. At this point the flexible portion 44 straightens out and, in effect, covers the gap between the top of the door and bottom of the track 48 as shown in FIG. 3.

Additionally, each of the doors 12 and 14 includes a hollow upper plastic door frame 20 provided with a metal reinforcing stiffener 22, which is channel-shaped in the preferred embodiment. Guide member 18 includes vertical flange members 92, 94 and 96 aligned with flange members 36, 38 and 40 respectively, and connected by a web 97.

Identical auxiliary roller tracks 46 are provided for each track member 16. Each auxiliary track 46 is formed from relatively thin sheet metal and includes at its lower end a j-shaped portion 48, which is attached to its associated flange 36 and 38 to automatically center the roller 60 received by it. Tracks 46 are adjustably attached to the track member 16 as by fasteners 82, in the embodiment shown, extending through slots 83. Notches 49 (FIG. 7A) facilitate the placement of the doors 12 and 14.

Figure 3:
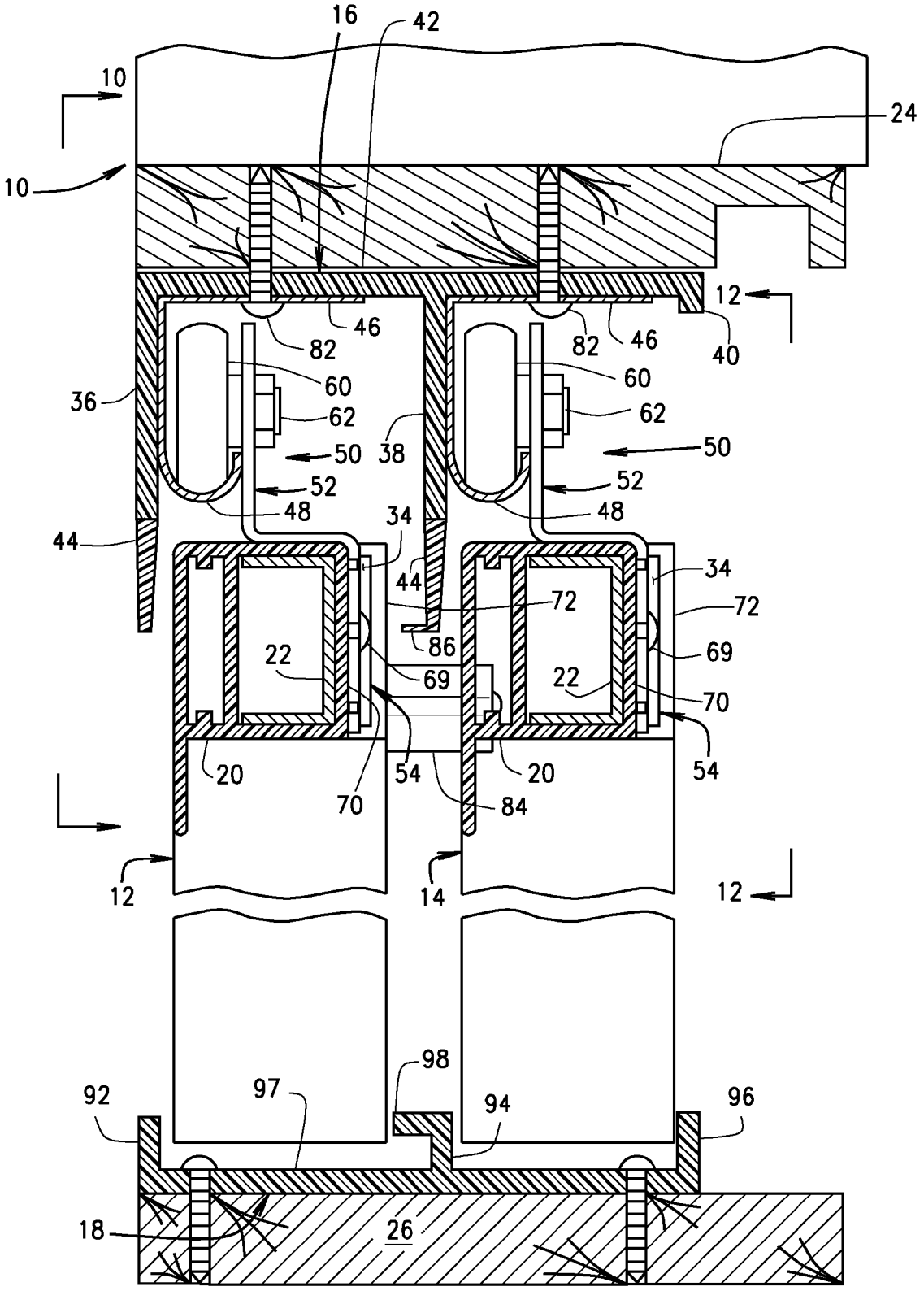
FIG. 3 is an enlarged fragmentary view of FIG. 2.

The rollers 60, shown in FIG. 3, and in detail in FIGS. 7-9 and 7A, are attached to a bracket 50 shown extending from the roller 60 to the upper door frame 20 which, in the preferred embodiment is of plastic. As shown, the metal bracket 50 includes an upper portion 52, which carries the roller 60 and a lower portion 54, which is attached to an inner web of the frame 20 by virtue of a recess 34.

As shown in FIG. 3 the upper frame portion 20 of the doors 12 and 14 includes intermediate partitions 70. Also as shown in FIG. 3 there is a space between the outer wall 72 and the intermediate partition 70. This arrangement permits a recess 34 to be provided by cutting away a portion of the outer wall 72 and the top and bottom walls. The lower portion 54 of the bracket 50 is fitted into recess 34 and fastened to the partition 70 and also to the bight portion of the channel-shaped stiffener 22 by means of the two fasteners 69. The bracket 50 is thus firmly secured to the metal stiffener bight portion as clearly shown in FIG. 12.

Figure 4:
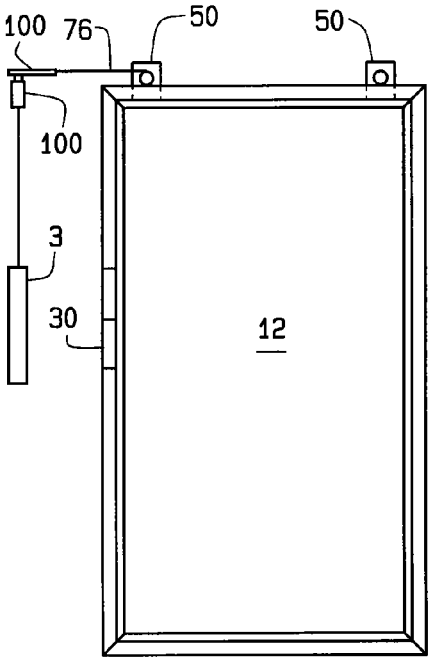
FIG. 4 is an elevational view of the outer door.
Figure 5:
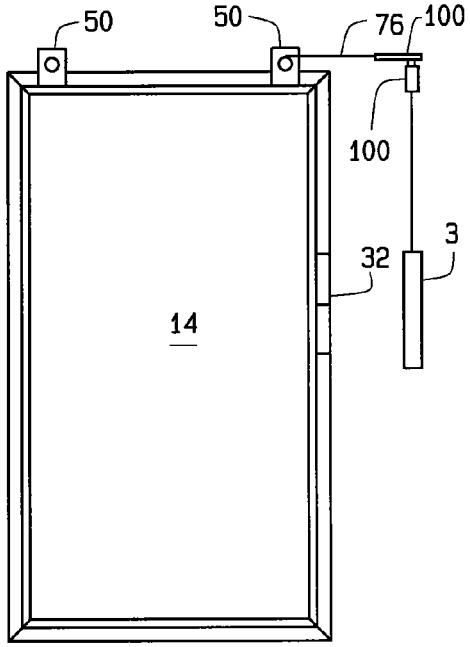
FIG. 5 is an elevational view of the inner door.
Figure 6:
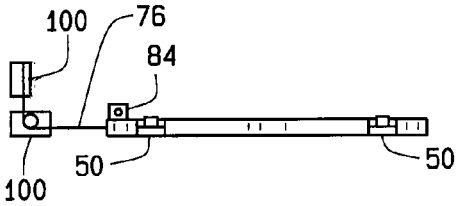
FIG. 6 is a top view of the inner door.
Figure 10:
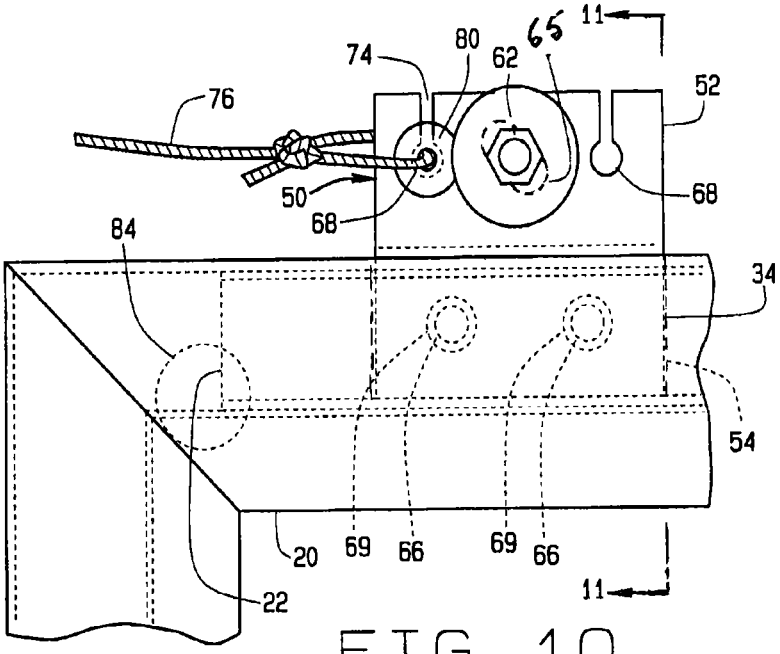
FIG. 10 is an enlarged view of a roller mounting bracket and a door stop installed on the outer door frame taken from the outside of the merchandiser (track omitted)

As also shown in FIG. 3 the roller wheel 60 is attached to the upper bracket portion 52 by an inner stud 62 disposed between the inner race 63 and outer race 61, said races being provided with balls 64. The bracket 50 includes two upper holes 68, which are opened to the upper margin 74 of the bracket upper portion 52, and sized to receive a plastic grommet or bushing 80 for attachment of the sash or door cord 76. This feature is best shown in FIG. 10 which is a view taken from the outside of the merchandiser and it will be understood that the grommet protects the sash line 76 against fraying. As also shown in FIG. 10 the bracket 50 includes an inclined slot 65, which is provided to receive the inner stud 62 in elevationally adjustable relation. The bracket upper portion 52 and lower portion 54 are connected by an intermediate plate portion 56 and the bracket 50 is preferably formed from a single bent plate. The bracket 50 lower portion 54 is connected to the plastic upper frame 20 and to the metal reinforcing member 22 of the associated door 12 or 14 by fasteners 69 through holes 66. FIGS. 4-6 also show the sash line arrangement.

Figure 11:
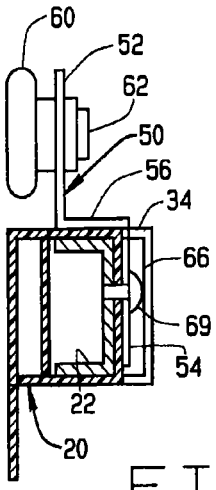
FIG. 11 is a cross-sectional view taken on line 11-11 of FIG. 10.
Figure 12:
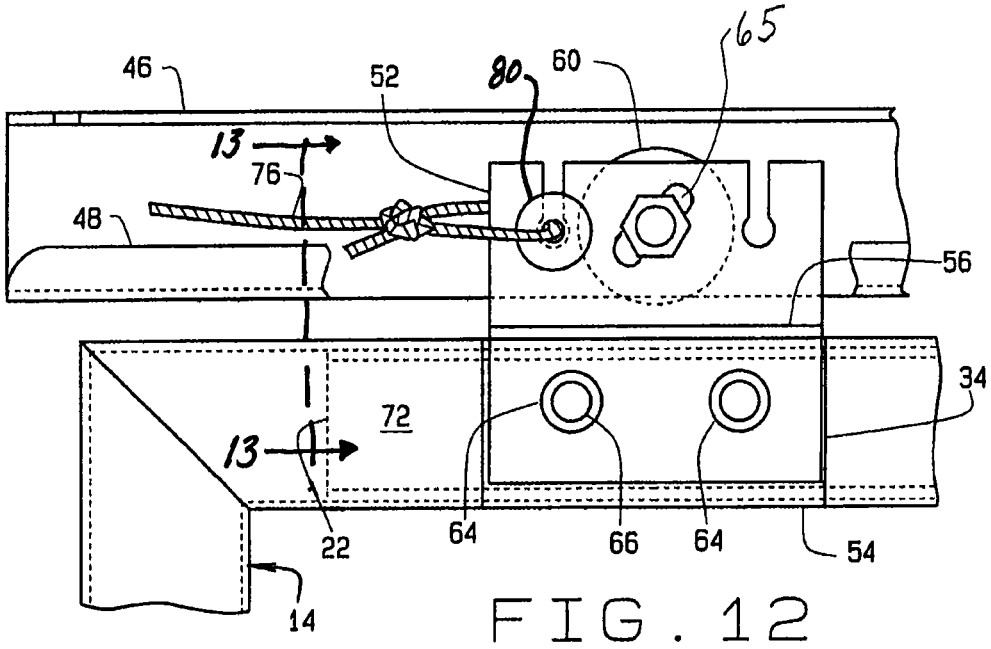
FIG. 12 is a view of a roller mounting bracket and a door stop installed on the inner door frame and taken from the inside of the merchandiser.
Figure 13:
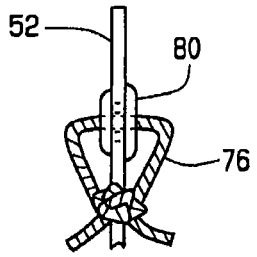
FIG. 13 is a view of the sash taken on line 13-13 of FIG. 12.
Figure 14:
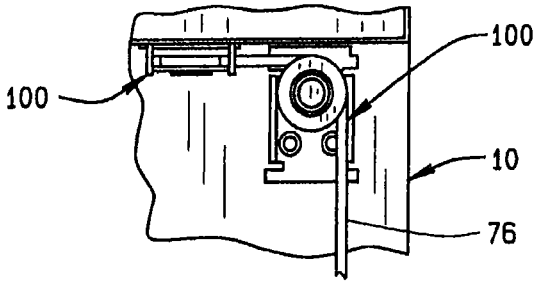
FIG. 14 is a view of a pulley assembly.

FIG. 12 is another view of the bracket assembly from the inside of the merchandiser. As shown, the bracket 50 is inserted into a recess formed in the vertical plastic wall of the upper door frame member 20 and indicated by numeral 34 in FIGS. 11 and 12. The first door 12 is fitted with a stop 84 to limit the movement of the second door 14.

A counterweight system is attached to the end of the sash line 76 similar to that shown in FIG. 1A which is taken from commonly owned U.S. patent application Ser. No. 11/110, 558 which is incorporated herein by reference. FIG. 10-13 illustrate the arrangement of the sash line at the grommet 80 having a knotted loop attached to the upper bracket portion at one end protected by the grommet 80 and attached to a counterweight at the other end as shown in FIGS. 4-6.

As shown in FIG. 3 the lower flexible portion 44 of the track includes a turned end 86 to assist in air sealing the doors at the upper end. The lower guide includes upstanding flanges 92, 94 and 96 connected by a web 97 which includes a turned end 98 to assist in air sealing the doors at the lower end. At least one door has a bumper stop 84 limiting movement of the door.

It is thought that the functional advantages of this top hung sliding door assembly have become fully apparent from the foregoing detailed description of parts, but for completeness of disclosure, the installation and operation will be briefly described.

The top hung sliding door assembly 10 is comprised essentially of a pair of doors 12 and 14, constituting first and second overlying adjacent doors, riding in an upper track 16 for movement between open and closed limits, each door including a door pull 30 and 32. The top hung nature of the doors 12 and 14 provides that the vertically aligned track member 16 and guide member 18 may be preinstalled in the merchandiser by virtue of longitudinal members 24 and 26, respectively.

The doors 12 and 14 are fitted with two brackets 50 each, the lower part of the bracket indicated by numeral 54 being attached in the door frame recesses 34 by fasteners 66 received into the openings 69. The brackets 50 each have roller wheels 60 pre-attached to the upper bracket portion 52. The auxiliary track members 46 are previously emplaced in the tracks 16 by virtue of fasteners 82 by way of slotted holes 83 which permit lateral adjustment of the track member 46 relative to the track 16 and, because of the j-shaped portions, the rollers 60 move automatically to a central position as shown in FIG. 3. Also the auxiliary track members 46 with notches 49 (FIG. 7 and FIG. 7A) permit the doors 12 and 14 to be easily lifted into position. The positioning of the doors relative to the track 46 is facilitated by the bendable flexible tips 44 which, when the doors are emplaced return to their original non-bent position protect and seal the doors against unnecessary air flow. Importantly, each plastic upper door frame member 20 has an elongate metal stiffening member 22 which strengthens the plastic frame member and permits the bracket 50 to be secured to the door frame and the stiffening members. Also, the brackets 50 have inclined slots for adjusting the elevation of the doors 12 and 14.

The lower flexible portion of the track 16 includes a turned end 86 to assist in air sealing the assembly. The lower guide portion includes a turned central portion 98 to assist in air sealing the assembly. At least the first door has a bumper stop 84 limiting movement of the second door 14.

Although the invention has been described by making detailed reference to a single preferred embodiment, such detail is to be understood in an instructive, rather than in any restrictive sense many variations being possible within the scope of the claims hereunto appended.

I claim as my invention:

1. A top hung door assembly for a merchandiser, the assembly comprising:

an upper track member including a pair of downwardly extending flanges attached to a web of the upper track member;

a pair of auxiliary tracks each of which is separately attached to the upper track member, each auxiliary track having a horizontally extending section that abuts against an underside of the web of the upper track member, the horizontally extending sections of the auxiliary tracks being attached to the upper track member by fasteners that pass through the web of the upper track member and the horizontally extending sections of the respective auxiliary tracks;

a horizontally extending support member attached to the merchandiser, the upper track member and each of the auxiliary tracks being secured to the support member by the fasteners;

a pair of doors each of which includes a roller assembly at respective upper ends of each door, each roller assembly including a generally S-shaped bracket having a vertically extending lower portion operatively connected to an associated door and a vertically extending upper portion carrying a roller, the upper portion of the bracket of each roller assembly including an inclined slot for receiving a roller stud used to adjust an associated door with which the slot is associated in the top hung door assembly, the slot being continuously open throughout its length of the slot for the roller stud to be variably positioned at non-discrete positions along the slot, the bracket having at least one opening therein for a sash line which is attached to the upper portion of the bracket, and a grommet fitting in the at least one opening in the bracket to protect the sash line from damage when the sash line is fitted through the at least one bracket opening; and, each door having a frame member at a respective one of said upper ends of said doors, each frame member including a channel shaped stiffening member, the lower portion of a respective bracket abutting against an outer wall of the frame member and secured to the frame member and stiffening member by a fastener that passes through the outer wall of the frame member and through a side of the stiffening member to secure the bracket to the door.

2. The top hung door assembly of claim 1 wherein the upper track member is of a unitary, one-piece construction and each flange has a flexible tip attached to a distal end thereof and extending downwardly in generally the same direction as the flange, the flexible tip of each flange being of a flexible material which is different from the material from which the rest of the flange is formed.

3. The top hung door assembly of claim 2 wherein each auxiliary track has a vertically extending section with a curved lower end forming a generally j-shaped portion, the roller carried by the upper portion of each bracket being received in the j-shaped portion of a respective auxiliary track to automatically center the roller in the track.

4. The top hung door assembly of claim 3 wherein each auxiliary track further includes two lengthwise spaced notches to facilitate mounting the roller assemblies in the j-shaped portion of the auxiliary track.

5. The top hung door assembly of claim 2 wherein at least one of the flexible tips has an outwardly turned end for assisting in sealing a door against air flow.

6. The top hung door assembly of claim 1 in which the stiffening member comprises a metal channel.

7. The top hung door assembly of 1 further including a door guide installed below a bottom of the doors and including a channel formed for receiving and guiding the bottom of each door during a sliding movement of each door.

8. The top hung door assembly of claim 7 wherein the door guide includes spaced upstanding flanges, one of the upstanding flanges having an outwardly turned upper end for affecting an air seal with a door.

9. The top hung door assembly of claim 1 wherein at least one of the pair of doors includes a bumper stop limiting movement of the other door.

* * * * *